US007470048B2

(12) United States Patent
Wu

(10) Patent No.: US 7,470,048 B2
(45) Date of Patent: Dec. 30, 2008

(54) FIRE-RATED RECESSED DOWNLIGHT

(76) Inventor: Liangju Wu, No. 19, Street 7, Gihu Haoting, Flowery Country Gardon, Cheneun Shundo, Foshan City, Guangdong (CN) 528000

( * ) Notice: Subject to any disclaimer, the term of this patent is extended or adjusted under 35 U.S.C. 154(b) by 306 days.

(21) Appl. No.: 10/592,911

(22) PCT Filed: May 23, 2005

(86) PCT No.: PCT/CN2005/000709

§ 371 (c)(1),
(2), (4) Date: Sep. 15, 2006

(87) PCT Pub. No.: WO2005/121642

PCT Pub. Date: Dec. 22, 2005

(65) Prior Publication Data

US 2008/0158862 A1 Jul. 3, 2008

(30) Foreign Application Priority Data

Jun. 9, 2004 (CN) ..... 2004 2 0046935 U
Aug. 20, 2004 (CN) ..... 2004 2 0083156 U
Jan. 21, 2005 (CN) ..... 2005 2 0003255 U

(51) Int. Cl.
*F21V 17/00* (2006.01)
*F21S 8/00* (2006.01)

(52) U.S. Cl. ..... 362/364; 362/147; 362/148; 362/150; 362/365

(58) Field of Classification Search ..... 362/147, 362/148, 150, 364, 365
See application file for complete search history.

(56) References Cited

U.S. PATENT DOCUMENTS

| | | | | |
|---|---|---|---|---|
| 3,778,609 | A * | 12/1973 | Liberman | 362/364 |
| 4,754,377 | A * | 6/1988 | Wenman | 362/148 |
| 6,357,891 | B1 * | 3/2002 | Newbold et al. | 362/147 |
| 6,431,723 | B1 * | 8/2002 | Schubert et al. | 362/147 |
| 7,320,536 | B2 * | 1/2008 | Petrakis et al. | 362/364 |

FOREIGN PATENT DOCUMENTS

| | | |
|---|---|---|
| EP | 0909919 | 4/1999 |
| GB | 2234938 | 2/1991 |
| GB | 2326467 | 12/1998 |
| NZ | 264352 | 6/1998 |
| WO | WO 98/12472 | 3/1998 |

* cited by examiner

*Primary Examiner*—Sandra OShea
*Assistant Examiner*—James W Cranson
(74) *Attorney, Agent, or Firm*—Charles E. Baxley

(57) ABSTRACT

The fire-rated recessed downlight includes a mantle, and a light fixture which is fixed in the mantle, said mantle having at least one radiating hole, in which a dilatable fireproof piece is fixed. The radiating hole is connected with outside of the mantle through a radiating aperture. The radiating hole of the mantle and the dilatable fireproof piece could help to radiate the heat in ordinary situations and the dilatable fireproof piece will expand rapidly to close the radiating hole when on fire, therefore the fire inside the mantle will not spread to the outside.

9 Claims, 9 Drawing Sheets

FIRE-RATED RECESSED DOWNLIGHT

BACKGROUND OF THE INVENTION

1. Field of the Invention

The present invention relates to the art of lighting fixtures, and especially to a fire-rated recessed downlight.

2. Description of the Prior Art

Conventionally, recessed downlights are fixed in roof, wall or furniture for prettification and illumination. The parts of the roof, the wall or the furniture in which the recessed downlights are fixed are usually made of fire-rated board to avoid flame spreading in the event of fire. And cutouts are defined in such parts for fixing the recessed downlights. But most of the present recessed downlights could not avoid spreading of fire and therefore ignite or melt other objects behind the fire-rated board, i.e., central floors such as framework and girder. So the fire-rated board could not effectively avoid spreading of fire and there is a big hidden danger with the conventional recessed downlights.

Accordingly, a fire-rated recessed downlight that solves the above problems is desired.

SUMMARY OF THE INVENTION

An object of the present invention is to provide a fire-rated recessed downlight.

To fulfill the above object, a fire-rated recessed downlight is applied according to the present invention. The fire-rated recessed downlight comprises a mantle and a light fixture which is fixed in the mantle, said mantle having at least one radiating hole, in which a dilatable fireproof piece is fixed. The radiating hole is connected with outside of the mantle through a radiating aperture.

As a result, the radiating hole of the mantle of the fire-rated recessed downlight and the dilatable fireproof piece could help to radiate the heat in ordinary situations and the dilatable fireproof piece will expand rapidly to close the radiating hole when on fire, therefore the flammable objects outside the mantle are completely insulated from the light fixture inside the mantle. So the fire inside the mantle will not ignite the objects outside.

Other objects, advantages and novel features of the present invention will become more apparent from the following detailed description when taken in conjunction with the accompanying drawings, in which:

DESCRIPTION OF PREFERRED EMBODIMENT OF THE INVENTION

Reference is now made to the drawings to describe the invention in detail.

Figure 1:
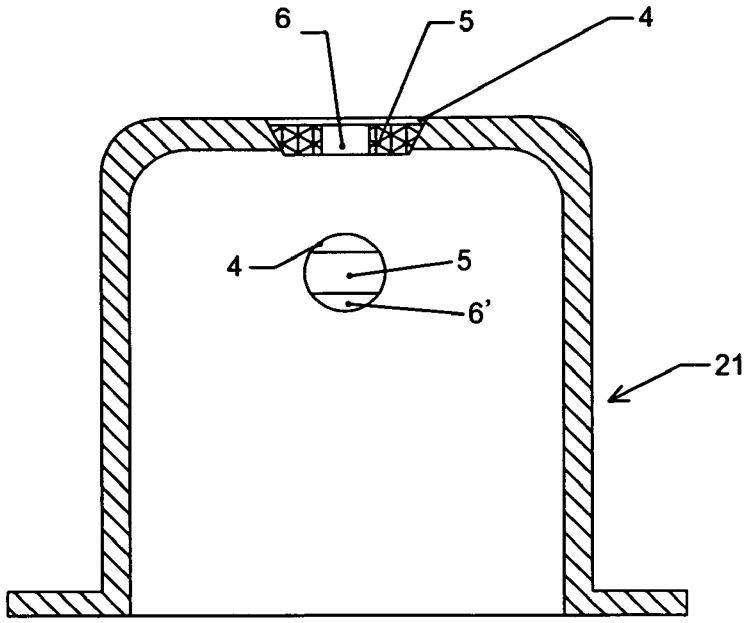
FIG. 1 is a cutaway view of a first embodiment according to the present invention.
Figure 2:
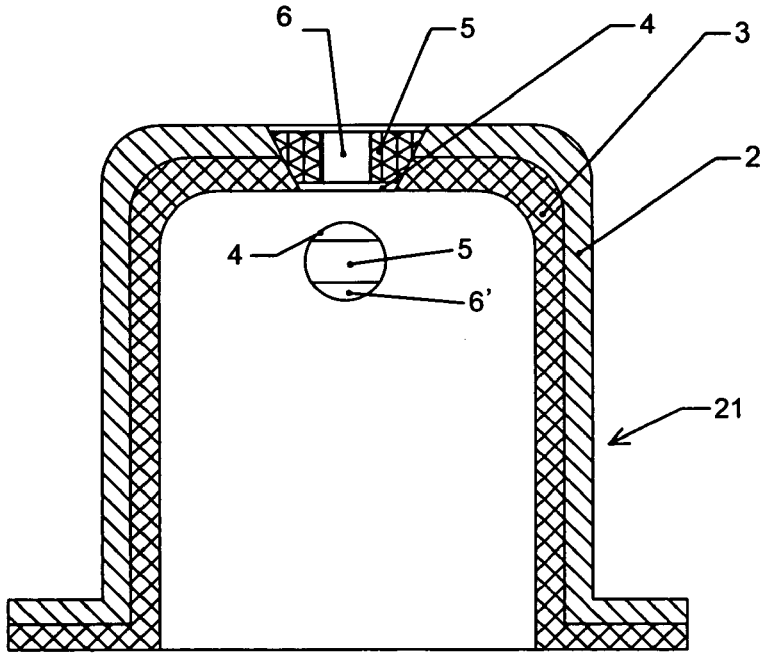
FIG. 2 is a cutaway view of a second embodiment according to the present invention.
Figure 6:
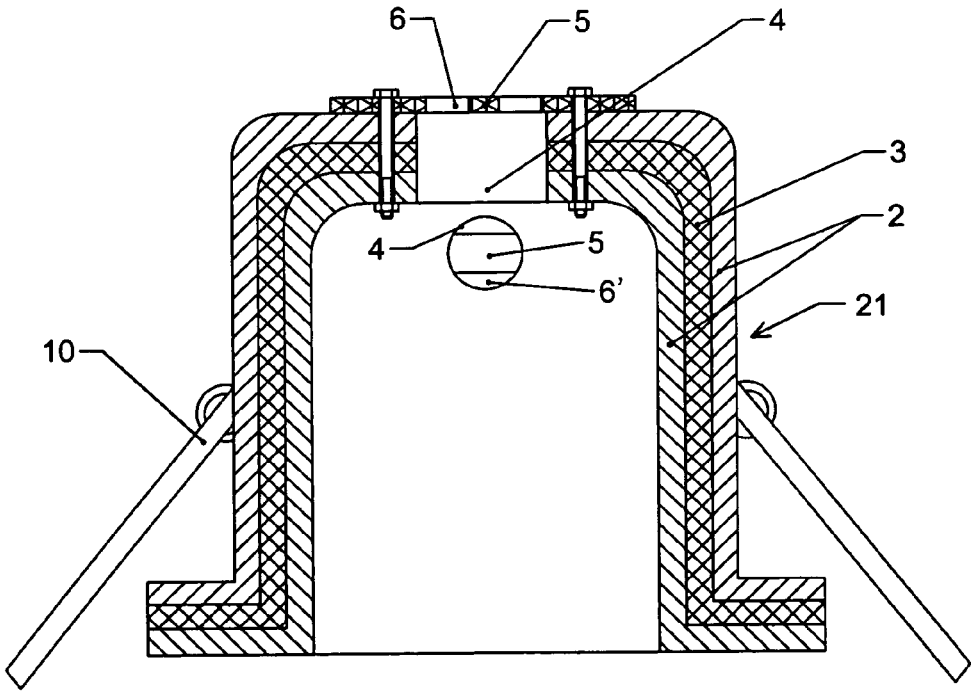
FIG. 6 is a cutaway view of a sixth embodiment according to the present invention.
Figure 11:
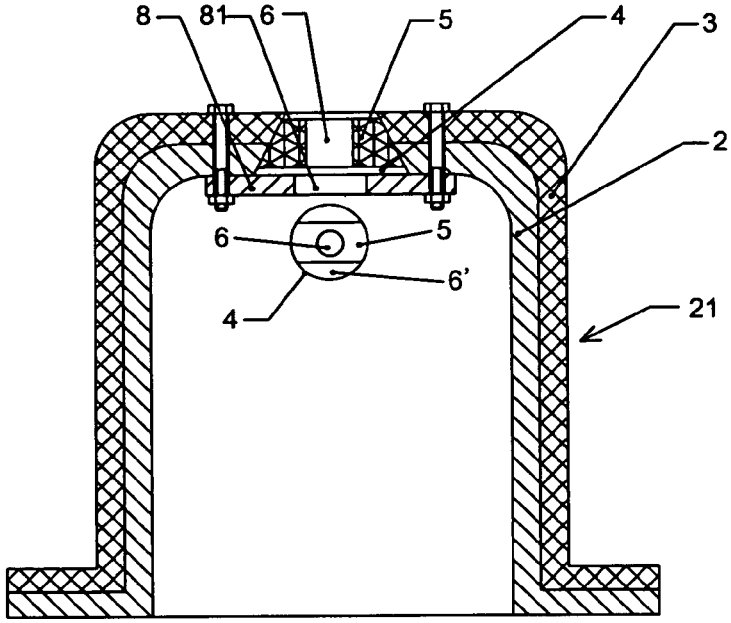
FIG. 11 is a cutaway view of an eleventh embodiment according to the present invention.
Figure 12:
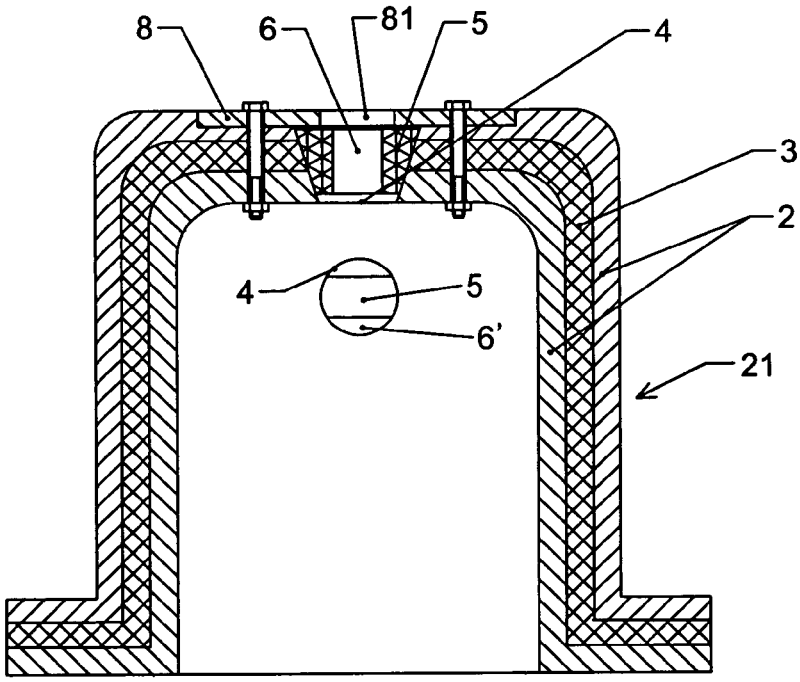
FIG. 12 is a cutaway view of a twelfth embodiment according to the present invention.

In order to show the structure expressly, except in FIGS. 7, 8, 16 and 17, in all the other FIGS. the light fixture 111 inside the mantle 21 is omitted. Referring to FIG. 1, a fire-rated recessed downlight, the mantle 21 of which has a radiating hole 4. In order to get an efficient radiation effect, the radiating hole 4 is usually defined on a top of the mantle. It may also be defined in a sidewall of the mantle. A dilatable fireproof piece 5 is fixed in the radiating hole 4. The dilatable fireproof piece 5 may also be fixed above or below the radiating hole 4, using bolts or by other means. Referring to FIG. 6, a radiating aperture 6 is defined in the dilatable fireproof piece 5 corresponding to the radiating hole 4. In another embodiment of the present invention, radiating apertures 6' are defined between the edges of dilatable fireproof piece 5 and the edges of radiating hole 4. In order to improve the radiation ability of the fire-rated recessed downlight, more than one radiating hole 4 could be defined on the mantle and more than one radiating aperture 6 could be defined on the dilatable fireproof piece 5. Also, in another embodiment of the present invention, more than one radiating aperture 6' could be defined between the edges of the dilatable fireproof piece 5 and the edges of the radiating hole 4. Referring to FIGS. 2 and 11, the dilatable fireproof piece 5 could be easily fixed in the taper of the radiating hole 4. Otherwise, referring to FIGS. 3, 11 and 12, a cover 8 could be fixed above or below the mantle or be embedded in the mantle corresponding to the radiating hole 4 to prevent the dilatable fireproof piece 5 from being divorced from the mantle. The radiating hole 4 of the mantle of the fire-rated recessed downlight could help to radiate the heat in ordinary situations; and the dilatable fireproof piece 5 will expand rapidly to close the radiating hole 4 when on fire, therefore the mantle will prevent the fire inside from igniting the objects outside. The dilatable fireproof piece 5 is made of fireproof, fire-rated and dilatable materials, i.e. the CP-25, CS-195 manufactured by American 3M Company or the CPS-AA546 manufactured by American Nelson Company.

Figure 3:
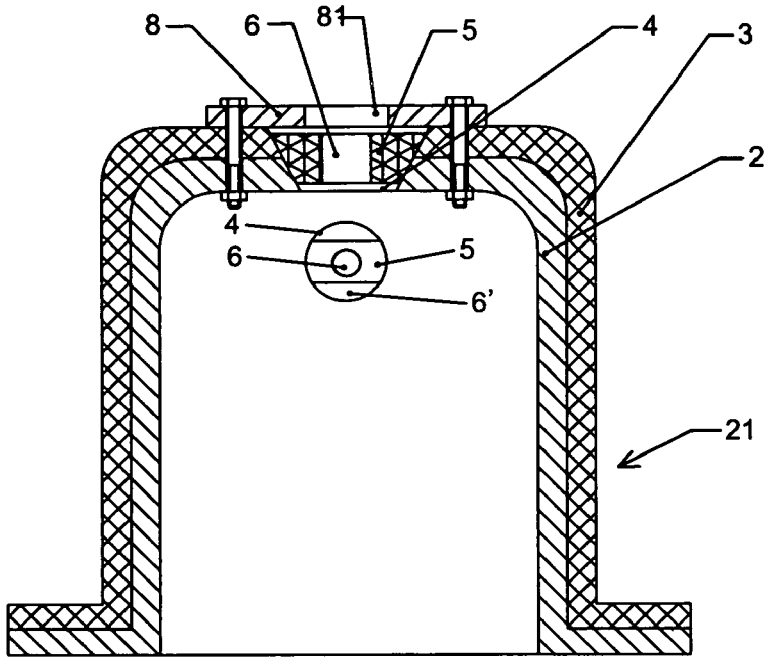
FIG. 3 is a cutaway view of a third embodiment according to the present invention.

Referring to FIG. 2, mantle 21 comprises a metallic layer 2 and a fireproof and/or adiabatic layer 3 inside the metallic layer 2; while referring to FIG. 3, mantle 21 comprises a metallic layer 2 and a fireproof and/or adiabatic layer 3 outside the metallic layer 2; mantle 21 can also comprise a metallic layer 2 and fireproof and/or adiabatic layers 3 both inside and outside the metallic layer 2. Wherein the metallic layer 2 is made of fire-resistant metallic material, such as iron, copper or aluminum. And the fireproof and/or adiabatic layer 3 is made of some ordinary fireproof adiabatic materials, such as aluminum silicate, rock wool or ceramic fiber. The mantle could avoid the fire spreading to the outside and the fireproof and/or adiabatic layer 3 could keep the outside surface of the mantle in a comparatively low temperature so as not to ignite combustible objects around the fire-rated recessed downlight.

Figure 9:
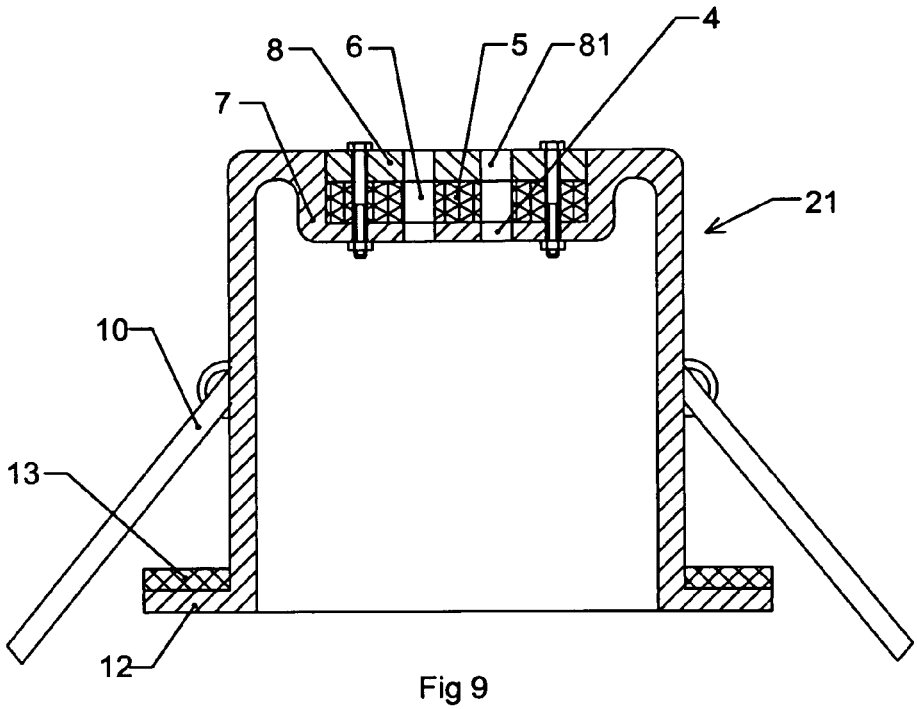
FIG. 9 is a cutaway view of a ninth embodiment according to the present invention.
Figure 10:
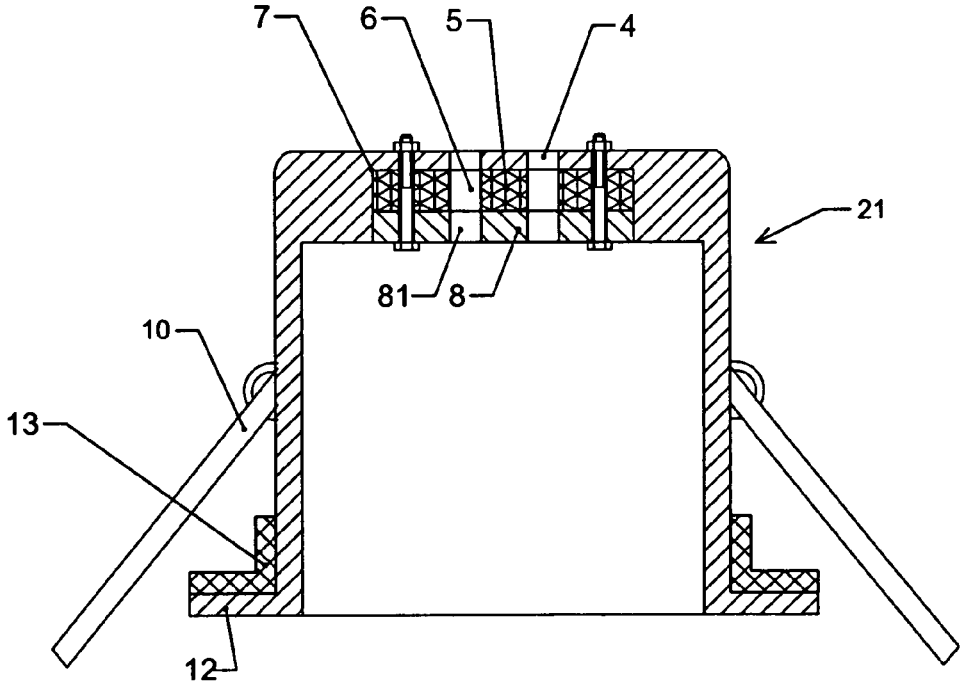
FIG. 10 is a cutaway view of a tenth embodiment according to the present invention.
Figure 17:
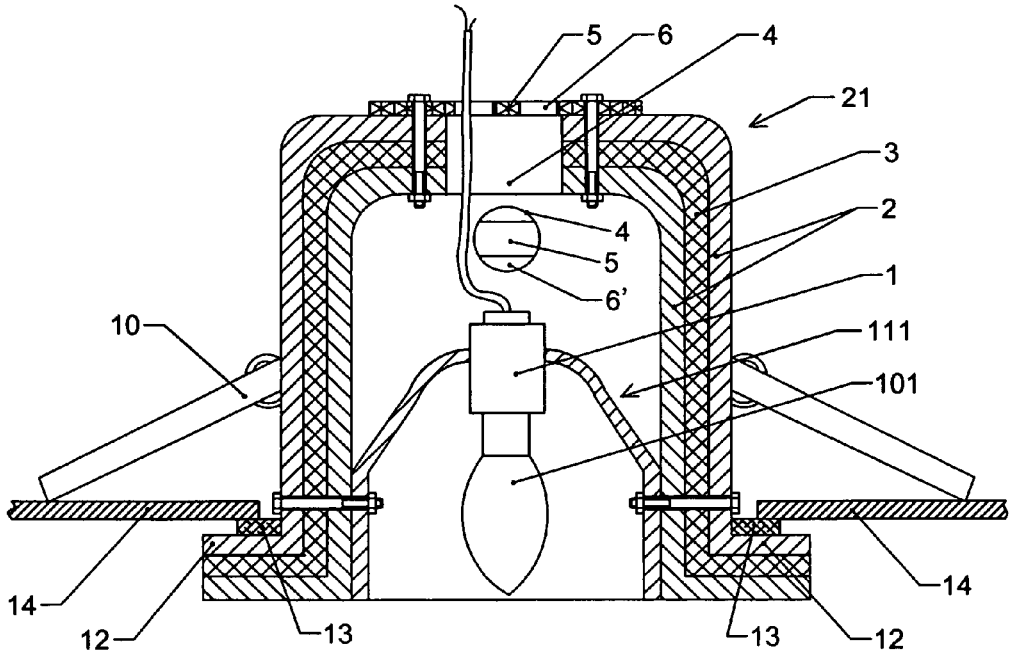
FIG. 17 is a cutaway view of a fire-rated recessed downlight in use according to the present invention.

The following structure can also be applied if the requirements is lower: an adiabatic piece 13 is formed on the bottom surface 12 of the mantle 21. The adiabatic piece 13 is usually formed to be ordinary gasket as shown in FIG. 9; or gasket with a portion extending upwardly along the sidewall of the mantle as shown in FIG. 10. Referring to FIG. 17, a recessed light is usually fastened on a board 14 by using the spring clips 10 to clamp the board 14 between the spring clips 10 and the bottom surface 12 of the mantle, so the rear of bottom surface 12 turns to contact with the board 14. The adiabatic piece 13 is used to prevent the high temperature of the bottom of mantle from singeing the board adjacent it. The adiabatic piece 13 is made of some ordinary fireproof adiabatic materials, such as aluminum silicate, rock wool or ceramic fiber. The adiabatic piece 13 could also be made of said fireproof, fire-rated materials to avoid the flame spreading through the cutout of the board.

Figure 4:
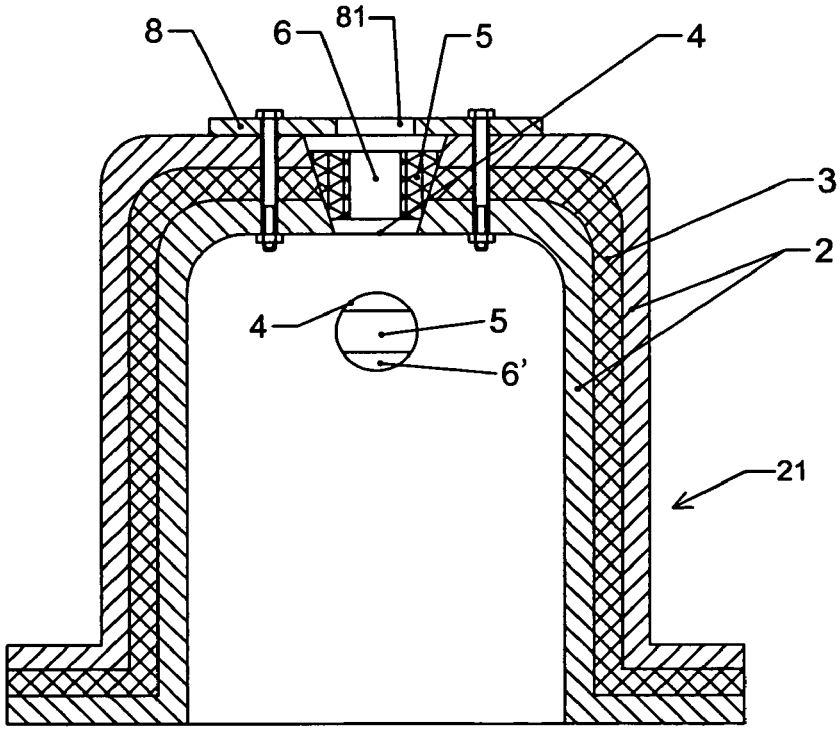
FIG. 4 is a cutaway view of a fourth embodiment according to the present invention.

Referring to FIG. 4, the mantle comprises two metallic layers 2 and one fireproof and/or adiabatic layer 3, which is between said two metallic layers 2. Such simple structure could efficiently protect the adiabatic layer 3.

Figure 5:
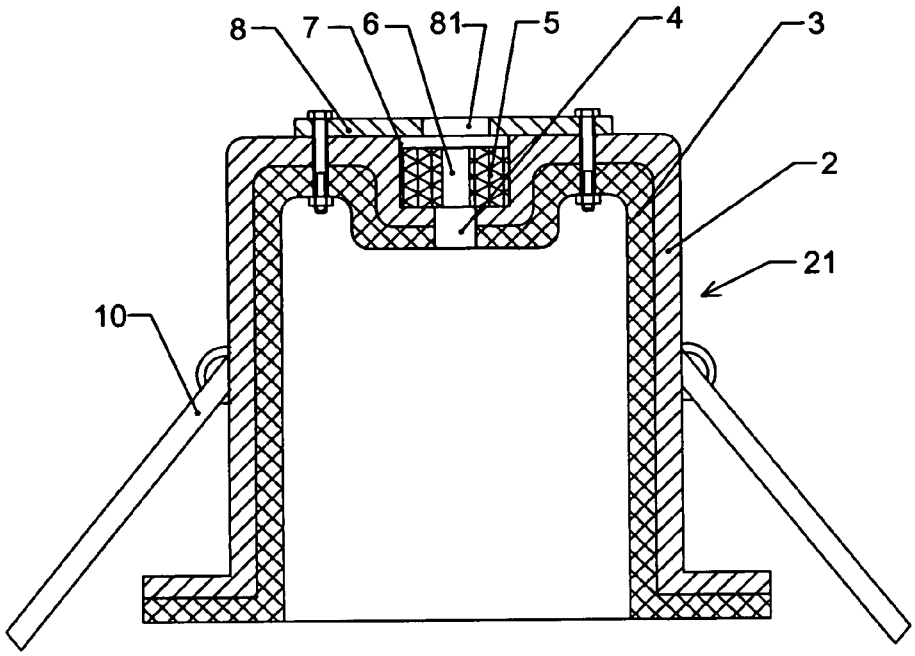
FIG. 5 is a cutaway view of a fifth embodiment according to the present invention.

Referring to FIG. 9, a concave 7 which is hollow in top is formed in top of the mantle to avoid the dilatable fireproof piece 5 being divorced from the radiating hole 4; or referring to FIG. 10, the concave can also be hollow in bottom. The radiating hole 4 is in the bottom of the concave 7 where the dilatable fireproof piece 5 is installed in and the cover 8 covers the dilatable fireproof piece 5. Holes 81 corresponding to radiating apertures 6 or 6' are defined in the cover 8. The cover 8 is fastened to the mantle. Referring to FIG. 5, the cover 8 could be mounted contacting the out surface of the mantle. In addition, referring to FIG. 9, the mantle comprises spring clips 10 to fasten the recessed downlight on the board. Other means, for example: by bolts, could also be used for fastening the mantle.

Figure 7:
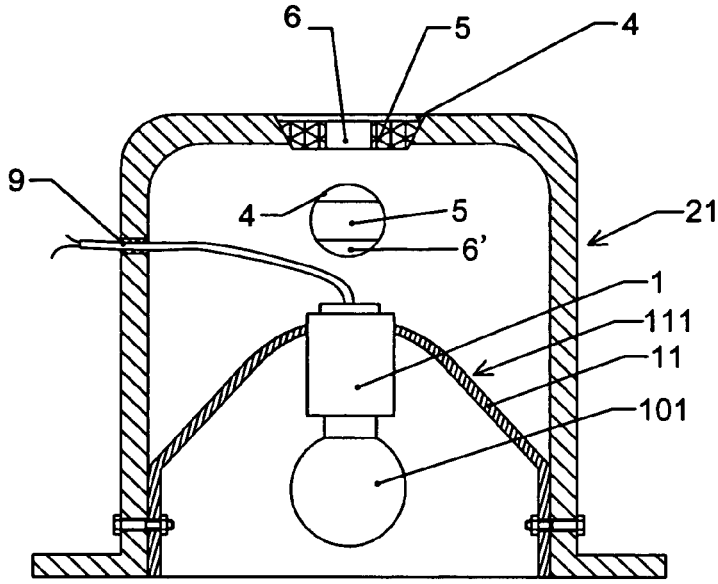
FIG. 7 is a cutaway view of a seventh embodiment according to the present invention.
Figure 8:
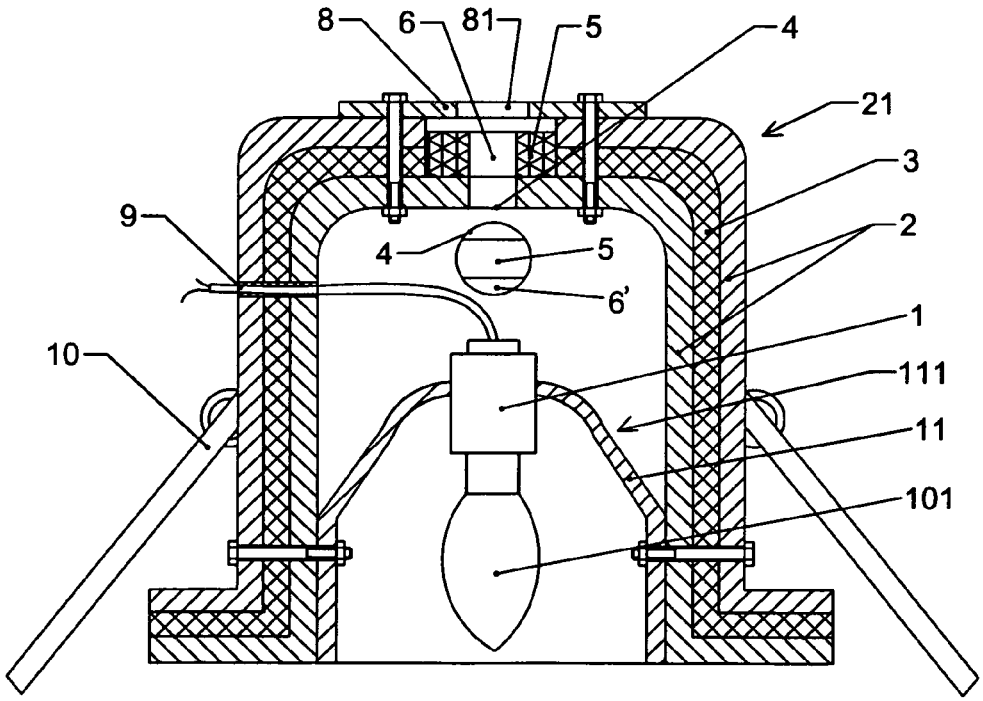
FIG. 8 is a cutaway view of an eighth embodiment according to the present invention.

Referring to FIGS. 7 and 8, a light fixture 111 is fixed in the mantle 21, which comprises a lampshade 11, at least one lamp holder 1 which is fixed on the lampshade 11, and at least one lamp 101 which is fixed in the lamp holder 1. An outlet hole 9 through which electrical wires are connecting with outside circuit is defined in the mantle. The outlet hole 9 is sealed with antiflaming materials or fireproof materials. Referring to FIG. 17, the electrical wires could also cross the radiating aperture 6 or 6' to connect with the outside circuit.

Figure 13:
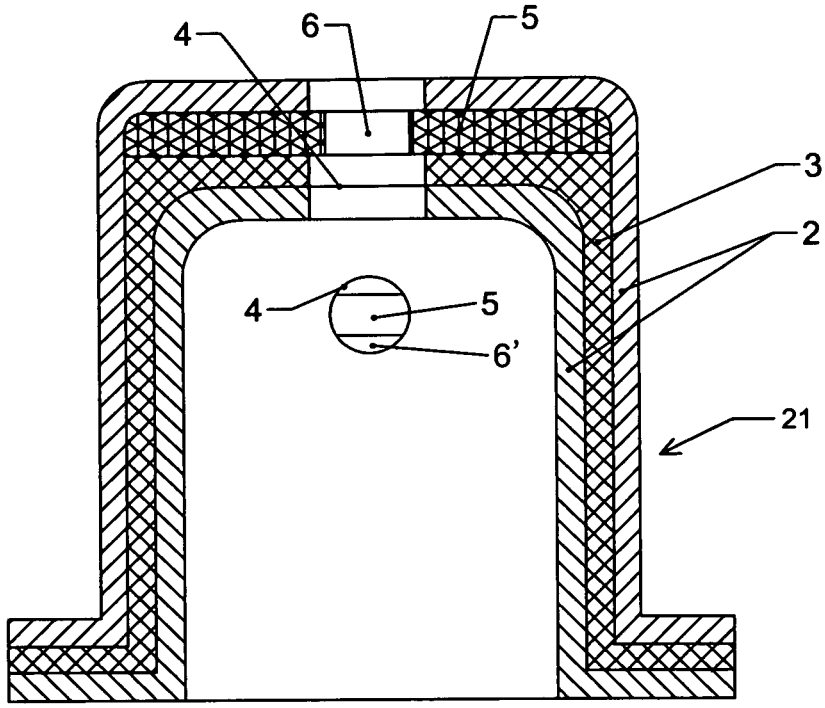
FIG. 13 is a cutaway view of a thirteenth embodiment according to the present invention.
Figure 14:
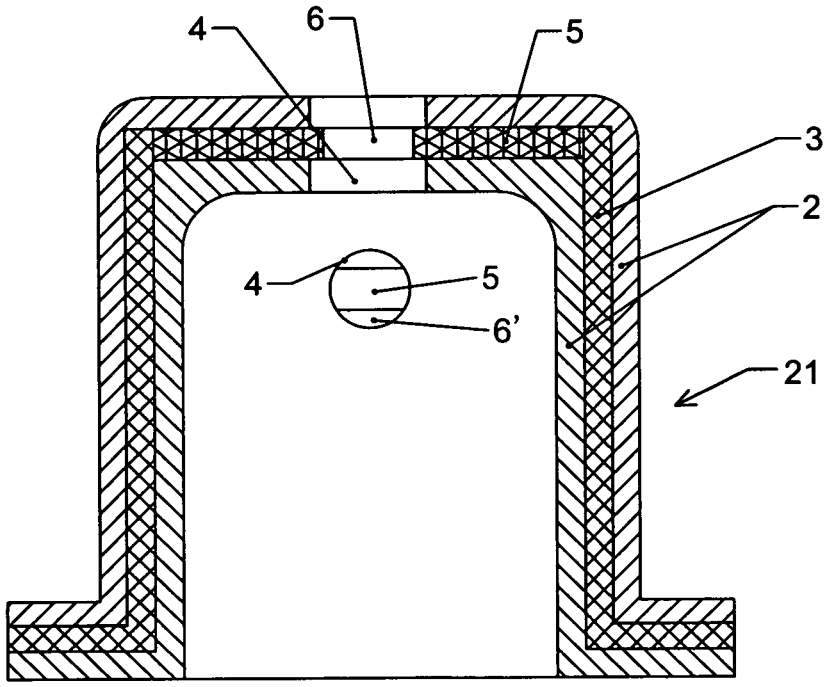
FIG. 14 is a cutaway view of a fourteenth embodiment according to the present invention.
Figure 15:
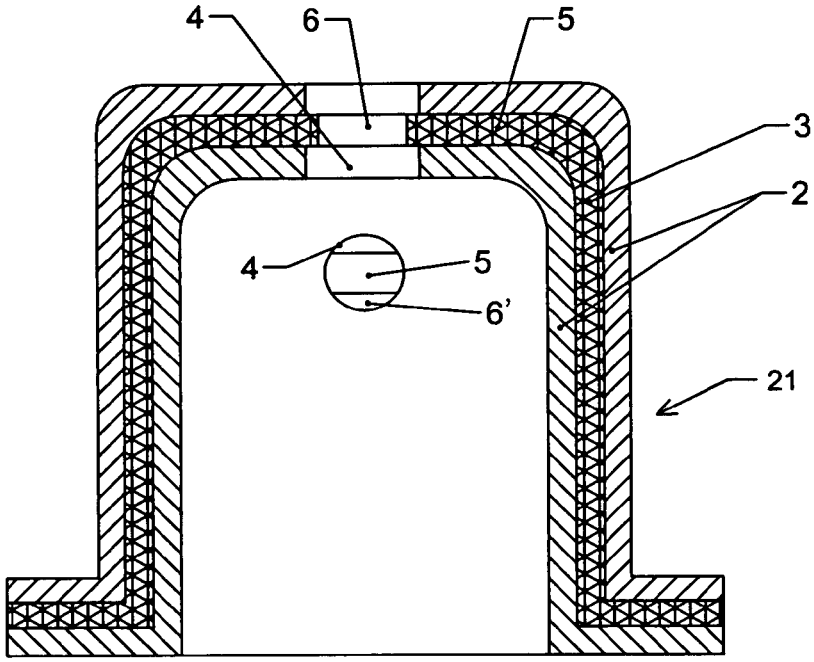
FIG. 15 is a cutaway view of a fifteenth embodiment according to the present invention.

In addition, the mantle could be defined as following: referring to FIGS. 13 and 14, the dilatable fireproof piece 5 could be fixed between two layers. And the fireproof and/or adiabatic layer 3 of the mantle could be made of said fire-rated materials and comprises radiating hole as shown in the FIG. 15. Such structure is more simple.

Figure 16:
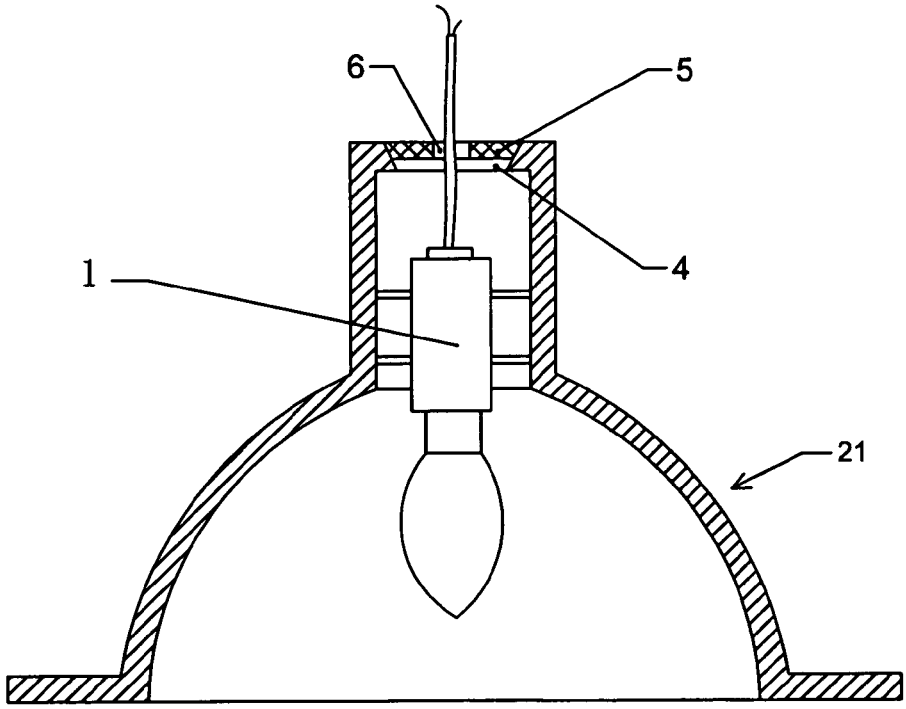
FIG. 16 is a cutaway view of a sixteenth embodiment according to the present invention.

Furthermore, although the present invention has been described with reference to particular embodiment, it is not to be construed as being limited thereto. Various alterations and modifications can be made to the embodiment without in any way departing from the scope or spirit of the present invention as defined in the appended claims. There are some other embodiments of the present invention. Referring to FIG. 16, the mantle could be an ordinary lampshade and the lamp holder 1 could be fixed in the mantle. In this way, the said mantle is not just used as an ordinary lampshade, but also a lampshade that is fireproof and adiabatic. Such simple structure could reduce the manufacture cost. Other means could be used to fix the lamp holder 1 in the mantle. In addition, the radiating hole 4 could be defined to be a counter bore as shown in FIG. 8. The dilatable fireproof piece 5 is inside the counter bore and the cover 8 covers the dilatable fireproof piece 5. With such structure, the fixing process of the dilatable fireproof piece 5 is comparatively easier.

What is claimed is:

1. A fire-rated recessed downlight, it comprising:

a mantle (21), a light fixture (111) which is fixed in the mantle (21);

wherein the said mantle (21) comprises at least one radiating hole (4) with a dilatable fireproof piece (5) fixed in said radiating hole (4); a radiating aperture (6) connects the radiating hole (4) with the outside of the mantle (21).

2. The fire-rated recessed downlight of claim 1, wherein the radiating aperture (6) is defined in the dilatable fireproof piece (5) corresponding to the radiating hole (4).

3. The fire-rated recessed downlight of claim 1, wherein at least one radiating aperture (6') is defined between the edges of said dilatable fireproof piece (5) and edges of said radiating hole (4).

4. The fire-rated recessed downlight of claim 1, wherein an adiabatic piece (13) is fixed on a bottom surface (12) of said mantle (21).

5. The fire-rated recessed downlight of claim 1, wherein said mantle (21) comprises a metallic layer (2) and a fireproof and/or adiabatic layer (3) inside and/or outside the metallic layer (2).

6. The fire-rated recessed downlight of claim 1, wherein said mantle (21) comprises two metallic layers (2) and one fireproof and/or adiabatic layer (3) which is between said two metallic layers (2).

7. The fire-rated recessed downlight of any one of claims 1-6, wherein said mantle (21) comprises a concave (7) and said radiating hole (4) is in a bottom of the concave (7), said dilatable fireproof piece (5) being fixed in said concave (7), and a cover (8) is fixed on said mantle (21) covering said dilatable fireproof piece (5), holes (81) corresponding to the radiating aperture (6) are defined in the cover (8).

8. The fire-rated recessed downlight of any one of claims 1-6, wherein said radiating hole (4) is defined in the top of said mantle (21).

9. The fire-rated recessed downlight of any one of claims 1-6, wherein said radiating hole (4) is defined in the sidewall of said mantle (21).

* * * * *